United States Patent [19]

Eilert

[11] 4,222,971

[45] Sep. 16, 1980

[54] HUMIDIFIER LINER

[76] Inventor: Richard L. Eilert, 1321 Surrey Ct., Algonquin, Ill. 60102

[21] Appl. No.: 960,629

[22] Filed: Nov. 14, 1978

Related U.S. Application Data

[63] Continuation of Ser. No. 811,781, Jun. 30, 1977, abandoned.

[51] Int. Cl.[2] ..... F24F 3/14

[52] U.S. Cl. ..... 261/92; 239/220; 261/DIG. 15; 261/DIG. 46

[58] Field of Search ..... 261/92, DIG. 15, DIG. 4, 261/DIG. 46, 91; 220/20.5, 464, 465, 470; 239/220

[56] References Cited

U.S. PATENT DOCUMENTS

| | | | |
|---|---|---|---|
| 1,812,356 | 6/1931 | Mills | 261/91 |
| 2,554,868 | 5/1951 | Mills | 261/91 |
| 2,987,212 | 6/1961 | Scanlon | 220/63 R |
| 3,197,071 | 7/1965 | Kuster | 220/63 R |
| 3,448,889 | 6/1969 | Malpas | 220/63 R |
| 3,456,927 | 7/1969 | Martin et al. | 261/DIG. 15 |
| 3,512,763 | 5/1970 | Winton | 261/DIG. 15 |
| 3,698,594 | 10/1972 | Boehlert | 220/63 R |
| 3,698,595 | 10/1972 | Gortz et al. | 220/63 R |
| 3,724,824 | 4/1973 | Mitich | 261/DIG. 15 |
| 3,729,112 | 4/1973 | Gibbs | 220/17 |
| 3,756,579 | 9/1973 | Remick | 261/92 |
| 3,779,419 | 12/1973 | Heitz | 220/63 R |
| 3,929,941 | 12/1975 | Horne | 261/DIG. 15 |
| 3,979,485 | 9/1976 | Hoag | 261/92 |

*Primary Examiner*—Frank W. Lutter
*Assistant Examiner*—Gregory N. Clements
*Attorney, Agent, or Firm*—Hume, Clement, Brinks, Willian & Olds

[57] ABSTRACT

A water-impervious liner for use in a humidifier having a rotatable drum provided with an evaporator medium and a liquid-holding chamber through which the drum is rotated, said liner being conformed to the shape of the chamber. In one of the embodiments having a single liner, the liner is divided into two chambers by means of a dividing wall having an aperture for the flow of liquid between the chambers. According to an embodiment having a plurality of liners, there is provided a water-impervious liner assembly for use in a humidifier having at least two chambers for holding liquid, wherein the humidifier liner assembly includes a first and a second water-impervious liner and a conduit means interconnecting the two chambers, and the conduit means is attached to the first liner and to the second liner in a watertight manner.

4 Claims, 5 Drawing Figures

FIG. 1
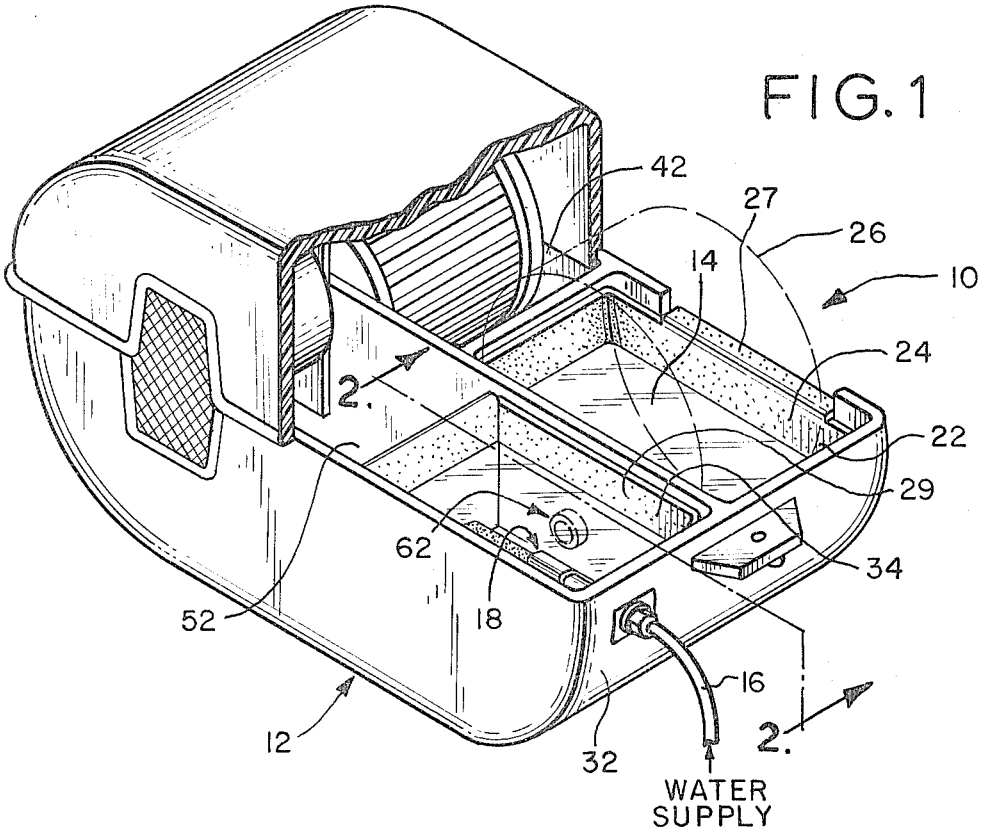
FIG. 2
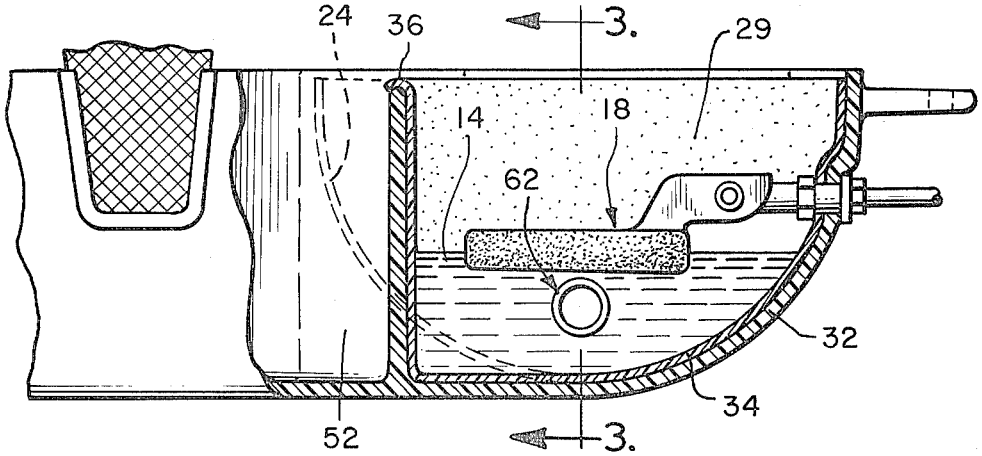
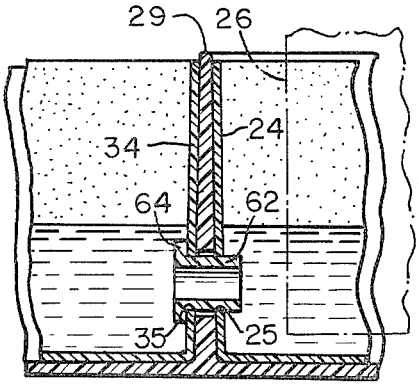
FIG. 3
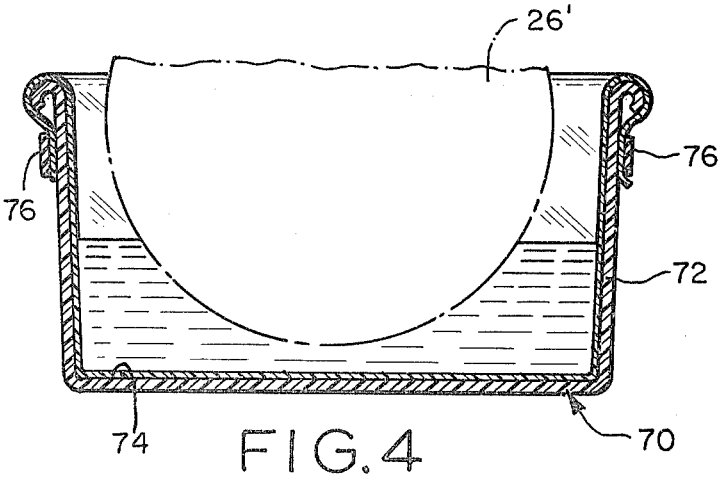
FIG. 4

HUMIDIFIER LINER

This is a continuation of application Ser. No. 811,781, June 30, 1977, now abandoned.

BACKGROUND OF THE INVENTION

The present invention relates to humidifiers, and in particular to a disposable, water-impervious liner for liquid reservoir chambers in the lower case of a humidifer, such as a drum-type humidifier connected to the air flow system of a furnace.

In the prior art drum-type humidifiers, such as disclosed in Stiles U.S. Pat. No. 3,476,673, a chamber is provided for holding tap water or other liquid which is applied to an evaporator medium of a rotating drum. The liquid is evaporated from the evaporator medium into a hot air stream of a furnace to humidify the air stream. Humidifiers are also known in the art to be used with air streams other than hot air streams of furnaces. Such a humidifier is disclosed in Remick U.S. Pat. No. 3,756,579.

A typical disadvantage of a drum-type humidifier utilizing a liquid reservoir chamber filled with tap water is that dirt, dust, lime and other mineral deposits accumulate in the chamber and must be periodically removed to prevent interference with rotation of the drum during operation of the humidifier. Furthermore, particular deposits such as lime or other minerals not only accumulate, but also adhere to surfaces of the chamber. In the prior art apparatus, removal of accumulated and adhering deposits of foreign matter is generally accomplished by obtaining access to the liquid reservoir chamber and scraping, chipping or otherwise removing the deposits from the chamber surfaces, and then removing the deposits from the chamber. Depending upon the ease of access to the liquid reservoir chamber and the ease of removal of the chamber for immersion in a cleaning solution, the task of removing accumulated deposits may present merely a bothersome chore or may be quite difficult.

Other prior art apparatus flow water through a humidifier chamber during humidifier operation to reduce mineral accumulation and algae and bacteria growth. Gallons of water are circulated and discarded during every hour of such humidifier operation, making such an apparatus unsuited for areas in which water conservation is desirable.

Moreover, if the humidifier has a plurality of liquid holding chambers, and means interconnecting the chambers for passage of liquid therethrough, not only is the number of surfaces which accumulate mineral and other deposits increased, but also the interconnecting means may be clogged or the flow of liquid therethrough otherwise reduced by the accumulation and adherence of mineral deposits to surfaces of the chambers and the interconnecting means.

SUMMARY OF THE INVENTION

According to the present invention, a liner for drum-type humidifiers is provided which overcomes the disadvantages of the prior art by eliminating the need for scraping, chipping or otherwise removing accumulated and adhering dirt, dust, lime or other mineral deposits from a surface of a humidifier chamber. The liner itself is water-impervious, relatively thin, and inexpensive, so that when accumulation of deposits reaches a level requiring removal, the liner is removed and disposed. A replacement liner is them inserted into the chamber.

For use in humidifiers including more than one liquid-holding chamber a humidifier liner assembly is provided which includes a plurality of humidifier liners, and conduit means interconnecting the liners so that watertight seals are created between the conduit means and the liners for the passage of liquid from one liner to the next without leakage of liquid into the space between the liners and their respective chambers. The liners are provided with at least one lip on an upper liner edge to assist in positioning of the liners within their respective chambers and to stiffen a liner wall to prevent buckling of the wall.

If a humidifier case is used in which separate chambers are not structurally defined, a humidifier liner is provided which includes a dividing wall to define chambers. The dividing wall additionally includes an aperture for the flow of liquid between the chambers.

The apparatus of the present invention provides many advantages. Removal of accumulated and adhering deposits, such as lime and other minerals, from the humidifier system is easily accomplished by removal of the humidifier liner. Because the liner is disposable, the present invention overcomes the disadvantages of having to chip, scrape or otherwise physically remove deposits from a surface to which the deposits have adhered. Damage to the surfaces of the humidifier chambers by such an abrasive or gouging type of cleaning action is thereby eliminated. Furthermore, the amount of tap water or liquid required in the apparatus of the present invention is not greater in comparison with humidifiers without liners in the prior art, and is much less than the amount of water used in humidifiers which circulate water to reduce mineral accumulation.

Accordingly, it is the primary object of this invention to provide an inexpensive, disposable liner for a humidifier chamber to eliminate the need for chipping, scraping, or other removal of mineral deposits from a surface of a humidifier liquid-holding chamber.

Another object of this invention is to provide a humidifier liner apparatus which presents minimal interference with operation of the humidifier because the liner is conformed to the shape of the chamber into which it is inserted.

A further object of this invention is to provide a humidifier liner assembly which includes a plurality of liners interconnected in a watertight manner by means of a conduit which permits the passage of liquid from one chamber to another and also assists in properly positioning the liners.

Other objects, features, and advantages of the invention will become apparent upon reading the following detailed description in conjunction with the accompanying drawings.

DESCRIPTION OF THE DRAWINGS

FIG. 1 is a top perspective view of an embodiment of the humidifier liner assembly of the present invention, illustrated in position within a lower case of a humidifier.

FIG. 2 is a cross-sectional view of the humidifier liner assembly of the present invention, taken along the line 2—2 of FIG. 1, illustrating the configuration of a liner and a conduit means within the liner;

FIG. 3 is a cross-sectional view of the humidifier liner assembly of FIG. 2, taken along the line 3—3, further illustrating a conduit means of the assembly;

FIG. 4 is a side cross-sectional view of another embodiment of the humidifier liner of the present invention illustrating an elastic band means for retaining the liner on a humidifier chamber.

DESCRIPTION OF THE PREFERRED EMBODIMENTS

Figure 5:
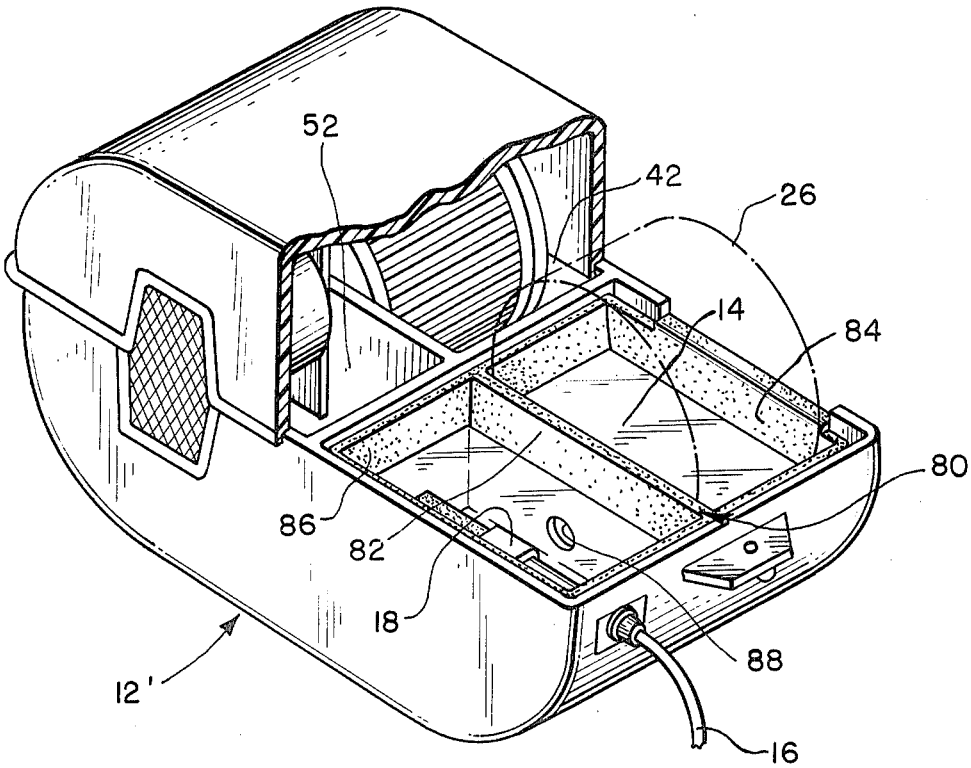
FIG. 5 is a top perspective view of a further embodiment of the humidifier liner assembly of the present invention, illustrated in position within a lower case of a humidifier and including a dividing wall within the liner.

Referring now to the drawings, and more particularly to FIG. 1, there is illustrated a liner assembly for drum-type humidifiers indicated generally by the reference numeral 10. The illustrated humidifier liner assembly as herein described is particularly suited for use with a drum-type furnace humidifier such as the one described in the Homart Furnace Humidifier Instruction Manual No. F642-952 for Model 303.93831, published by Sears, Roebuck and Co., incorporated by reference herein. Such a drum-type humidifier generally employs a cylindrical sleeve of an open pore material such as polyurethane foam as an evaporator medium. The sleeve is partially immersed in a liquid-containing chamber and is constantly rotated at a slow speed while air is forced about the sleeve to add moisture to the air. The liquid in the chamber is typically tap water and the level of the water is generally maintained at a substantially constant level by means of a float arm assembly operatively connected to a tap water supply. The humidifier is typically mounted on or near a hot air furnace system, and appropriate duct work is provided so that the air circulated by the furnace passes through the humidifier to humidify the air.

One type of furnace humidifier, for which the liner assembly apparatus of the present invention is particularly suited, includes a lower case 12 which is separated into four chambers: a first chamber 22 accommodates an evaporator medium drum 26 and also retains liquid 14 to be evaporated; a second chamber 34 contains a reservoir of liquid 14; a third chamber 42 contains a blower fan, and a fourth chamber 52 contains a motor to drive the blower fan. This drum-type humidifier typically uses a supply of tap water which is continuously replenished by a water supply tube 16 in operable relationship with an automatic float arm assembly 18. While using tap water as the liquid to be evaporated has the advantage of generally being cheaper than using distilled water in the humidifier system, various impurities, particularly lime and other minerals, are typically found in tap water, often referred to as "hard water," and tend to precipitate from the water solution and adhere to various chambers of the humidifier assembly.

According to the present invention, as illustrated in FIGS. 1, 2, and 3, there are included within the water-containing chambers, i.e., the first chamber 22 and the second chamber 32, a first liner 24 and a second liner 34, respectively. The adjacent chambers 22 and 32 have a common wall 29. The liners 24 and 34 are pre-formed of a relatively thin material to conform to the shape of the chambers 22 and 32 and rest within the chambers. These pre-formed humidifier liners 24 and 34 are each provided with a lip such as lip 27 as shown in FIG. 1 and lip 36 as shown in FIG. 2, on at least one upper edge of each of the liners 24 and 34. By means of this lip conformed to be positioned against an upper surface of a wall of the chambers 22 and 32, the liners 24 and 34 are easily aligned within their respective chambers 22 and 32. Moreover, each lip 27 and 36 stiffens the liner wall to which it is connected in order to prevent buckling of the wall.

A means interconnecting the chambers 22 and 32 is provided by an opening in the common wall 29 into which a hollow conduit plug 62 is inserted. Without the liners 24 and 34, the opening located in the common wall 29 would be adequate to allow the passage of liquid to be evaporated between the first chamber 22 and the second chamber 32. However, the conduit plug 62 is included in the preferred embodiment to prevent water from infiltrating between either of the liners 24 and 34 and their respective chambers 22 and 32. Such infiltration of water would cause the liners 24 and 34 to float above a surface of the chambers 22 and 32, thereby allowing mineral deposits to form underneath each of the liners 24 and 34 so that the problems and disadvantages of mineral deposits adhering to chamber surfaces as in the prior art would not be overcome.

To prevent leakage of water into the area between the liners 24 and 34, and their respective chambers 22 and 32, the conduit plug 62 is inserted into the opening and is press-fitted into a first aperture 25 within the first liner 24, and into a second aperture 35 within the second liner 34. As shown in FIG. 3, both the apertures 25 and 35 are aligned with the interconnecting opening in the common wall 29 for the passage of liquid from the second liner 34 to the first liner 24 through the conduit plug 62. The outer surface of the conduit plug 62 is in frictional engagement with the periphery of each aperture 25 and 35 to effect watertight seals. Furthermore, the plug 62 has a retaining lip 64 at one end to assist in positioning the plug 62 axially within the apertures 25 and 35.

In the preferred embodiment shown in FIGS. 1, 2, and 3, the conduit plug 62 is constructed from a water-impervious material which expands upon exposure to water so that the desired watertight seal is easily and properly achieved. Such a suitable material is nylon, which typically swells slightly when immersed in water.

In addition to maintaining a watertight conduit for transfer of water between the first chamber 22 and the second chamber 32, the conduit plug 62 also holds each liner 24 and 34 in desired relationship with respect to each chamber 22 and 32 to prevent shifting of the liners 24 and 34 due to manufacturing tolerances whereby the liners 24 and 34 may rub against either the float arm assembly 18 or the evaporator medium drum 26.

According to another embodiment of the present invention illustrated in FIG. 4, there is provided a humidifier liner for use in a drum-type humidifier having a single chamber for accommodating a rotating evaporator medium drum, and wherein a chamber water level control is remote to the single chamber. The humidifier liner assembly is indicated generally by reference numeral 70. An evaporator medium drum 26' is accommodated within a water reservoir chamber 72 in the lower case of the humidifier. In this embodiment, the reservoir chamber liner 74 is a thin, flexible material, such as a plastic sheet, which is draped to fit the shape of the reservoir chamber 72 so that the liner 74 need not be pre-formed to the shape of the reservoir chamber 72. The liner 74 conforms to the shape of the chamber 72 due the force of the weight of liquid within the chamber 72. The liner 74 is held against peripheral walls of the chamber 72 to insure proper alignment and retention of the liner within the chamber 72 by means of an elastic band 76 fitted around the peripheral walls. Although in this embodiment the reservoir chamber 74 is illustrated as a plastic sheet draped within the chamber, the liner may alternatively be constructed to fit within the chamber, in a fashion similar to the liners 24 and 34 of the embodiment shown in FIGS. 1, 2, and 3.

In the further embodiment of the present invention illustrated in FIG. 5, there is provided a humidifier liner for use in a drum type humidifier having a single chamber in a lower case 12' large enough to accommodate both a rotating evaporator medium drum 26 and a chamber water level control 18. The dual-chamber liner 80 has a dividing wall 82 within the liner 80 so that two chambers are provided: a first chamber 84 for the medium drum 26 and a second chamber 86 for the water level control 18. The dual-chamber liner 80 is preformed to the shape of the single chamber of the lower case 12' in which it rests. The dividing wall 82 is provided with an aperture 88 which permits fluid to flow between the chambers 84 and 86. This embodiment does not use a conduit plug because the dual chamber liner 80 is a single unit. The liner 80 is fully removable, disposable, and replaceable.

The liners 24 and 34, the flexible sheet liner 74, and the dual-chamber liner 80 are constructed from any suitable water-impervious material. Because the liners are meant to be disposable, an inexpensive material such as plastic is desirable. For the pre-formed liners 24, 34, and 80 any suitable thermoplastic or thermosetting resin may be used. Thermoplastic resin is typically less expensive and more easily formable at law heat, and therefore such thermoplastics as high impact polystyrene, polyethylene, and ABS, are particularly suitable in the present invention. This thermoplastic resin is vacuum-formed in the shape of the inside contour of the chamber into which it will be inserted. In the embodiment of the present invention depicted in FIG. 4, the liner 74 is preferably a thin plastic sheet such as a very flexible polyethylene.

The preferred embodiments of the apparatus of the present invention thus provide an inexpensive and relatively easy means for removing accumulated and adhering mineral deposits from chambers of drum-type humidifiers by means of a thin liner which is conformed to the shape of the chamber in which it rests. Though the embodiments hereinbefore described are preferred, many modifications and refinements which do not depart from the true spirit and scope of the invention may be conceived by those skilled in the art. For instance, the present invention may also be used with portable humidifiers which are not directly connected to a hot air furnace system, but which do use tap water or other liquid containing impurities such as lime or other minerals. It is intended that all such modifications and refinements be covered by the following claims.

I claim:

1. The combination of a water-impervious humidifier liner assembly and a humidifier having a rotatable drum provided with an evaporator medium, a first chamber and a second chamber being provided with a common wall, said first chamber accommodating the rotatable drum so that the water is applied to the evaporator medium, said second chamber providing a reservoir for the water, and an opening in the common wall for passage of the water between said first chamber and said second chamber, wherein the humidifier liner assembly comprises:

a water-impervious first liner for said first chamber, said first liner being substantially conformed to the shape of said first chamber and provided with a first aperture aligned with said opening;

a water-impervious second liner for said second chamber, said second liner being substantially conformed to the shape of said second chamber and provided with a second aperture aligned with said opening; and a hollow plug, inserted within said opening and press-fitted into said first aperture and said second aperture, said hollow plug being constructed from a water-impervious material which expands upon exposure to water whereby a water-tight seal is created between said plug and said first liner and between said plug and said second liner for the flow of water through said hollow plug between said first liner and said second liner.

2. In combination with a humidifier having a rotatable drum provided with an evaporator medium, a first chamber and a second chamber for holding water, said first chamber and said second chamber being provided with a common wall, said first chamber accommodating the rotatable drum so that the water is applied to the evaporator medium, said second chamber providing a reservoir for the water, and an opening in the common wall for passage of the water between said first chamber and said second chamber, the improvement comprising:

a water-impervious first liner for said first chamber, said first liner being substantially conformed to the shape of said first chamber and provided with a first aperture aligned with said opening;

a water-impervious second liner for said second chamber, said second liner being substantially conformed to the shape of said second chamber and provided with a second aperture aligned with said opening; and a hollow plug, inserted within said opening and into said first aperture and said second aperture, said hollow plug being constructed from a water-impervious material which expands upon exposure to water whereby a water-tight seal is created between said plug and said first liner and between said plug and said second liner for the flow of water through said hollow plug between said first liner and said second liner.

3. In combination with a humidifier having a rotatable drum provided with an evaporator medium, a first chamber and a second chamber for holding water, said first chamber accommodating the rotatable drum so that the water is applied to the evaporator medium, said second chamber providing a reservoir for the water, and a means interconnecting the first chamber and the second chamber for passage of the water therethrough, the improvement comprising:

a water-impervious first liner for said first chamber, said first liner being substantially conformed to the shape of said first chamber and provided with a first aperture aligned with said interconnecting means;

a water-impervious second liner for said second chamber, said second liner being substantially conformed to the shape of said second chamber and provided with a second aperture aligned with said interconnecting means; and a hollow plug, inserted within said interconnecting means and through said first aperture and said second aperture whereby the water flows through said hollow plug between said first liner and said second liner, said hollow plug being attached to said first liner and to said second liner in a water-tight manner.

4. The improvement of claim 3 wherein said first chamber and said second chamber of the humidifier liner assembly are provided with a common wall, wherein said interconnecting means is an opening in the common wall, and wherein said hollow plug is press-fitted into said first aperture and said second aperture.

* * * * *